US012129751B2

(12) United States Patent
Hansen et al.

(10) Patent No.: US 12,129,751 B2
(45) Date of Patent: Oct. 29, 2024

(54) ADAPTIVE TRAJECTORY CONTROL FOR AUTOMATED DIRECTIONAL DRILLING

(71) Applicant: Baker Hughes Oilfield Operations LLC, Houston, TX (US)

(72) Inventors: Christian Hansen, Niedersachsen (DE); Kai Karvinen, Niedersachsen (DE); Sanjib Kumar Jena, Niedersachsen (DE); Clemens Vanja Rene Klemme, Niedersachsen (DE); Karthik Nageshwara Rao, Hessen (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/882,109

(22) Filed: Aug. 5, 2022

(65) Prior Publication Data

US 2023/0046043 A1 Feb. 16, 2023

Related U.S. Application Data

(60) Provisional application No. 63/230,375, filed on Aug. 6, 2021.

(51) Int. Cl.
*E21B 44/00* (2006.01)
*E21B 7/06* (2006.01)

(52) U.S. Cl.
CPC ..... *E21B 44/00* (2013.01); *E21B 7/06* (2013.01); *E21B 2200/20* (2020.05)

(58) Field of Classification Search
CPC ..... E21B 44/00; E21B 7/06; E21B 2200/20
See application file for complete search history.

(56) References Cited

U.S. PATENT DOCUMENTS 10,746,009 B2 8/2020 Hoehn et al.
2009/0000823 A1* 1/2009 Pirovolou ..... E21B 7/04 175/61
2010/0185395 A1 7/2010 Pirovolou et al.
(Continued)

FOREIGN PATENT DOCUMENTS

GB 2498831 A 7/2013

OTHER PUBLICATIONS

International Search Report and Written Opinion; PCT/US2022/039389; Korean Intellectual Property Office; Mailed Nov. 8, 2022; 9 pages.

*Primary Examiner* — Dany E Akakpo
(74) *Attorney, Agent, or Firm* — CANTOR COLBURN LLP

(57) ABSTRACT

Examples described herein provide a method for drilling a wellbore by a wellbore operation system into a subsurface of the earth. The wellbore operation system includes a bottom hole assembly. The method includes conveying the bottom hole assembly into the wellbore. The method further includes selecting a well plan for the wellbore. The method further includes measuring well data by at least one sensor in the wellbore operation system while the bottom hole assembly is in the wellbore. The method further includes generating, by a processing device, a steering proposal based at least in part on the well plan and the well data. The method further includes drilling, with the wellbore operation system, at least a portion of the wellbore based at least in part on the steering proposal.

18 Claims, 9 Drawing Sheets

(56) References Cited

U.S. PATENT DOCUMENTS

| | | | | |
|---|---|---|---|---|
| 2016/0130878 | A1 | 5/2016 | Cobern | |
| 2019/0323333 | A1 | 10/2019 | Ellis et al. | |
| 2020/0248545 | A1 | 8/2020 | Maus et al. | |
| 2022/0170359 | A1* | 6/2022 | Boualleg | G06N 20/20 |
| 2022/0290550 | A1* | 9/2022 | Ba | E21B 44/00 |
| 2023/0392447 | A1* | 12/2023 | Ignova | E21B 45/00 |

* cited by examiner

ADAPTIVE TRAJECTORY CONTROL FOR AUTOMATED DIRECTIONAL DRILLING

CROSS-REFERENCE TO RELATED APPLICATIONS

This application claims the benefit of U.S. Provisional Patent Application Ser. No. 63/230,375 filed Aug. 6, 2021, the disclosure of which is incorporated herein by reference in its entirety.

BACKGROUND

Embodiments described herein relate generally to downhole exploration and production efforts in the resource recovery industry and more particularly to techniques for adaptive trajectory control for automated directional drilling.

Downhole exploration and production efforts involve the deployment of a variety of sensors and tools. The sensors provide information about the downhole environment, for example, by collecting data about temperature, density, saturation, and resistivity, among many other parameters. This information can be used to control aspects of drilling and tools or systems located in the bottom hole assembly, along the drillstring, or on the surface.

SUMMARY

Embodiments of the present invention are directed to adaptive trajectory control for automated directional drilling.

A non-limiting example method for drilling a wellbore by a wellbore operation system into a subsurface of the earth is provided. The wellbore operation system includes a bottom hole assembly. The method includes conveying the bottom hole assembly into the wellbore. The method further includes selecting a well plan for the wellbore. The method further includes measuring well data by at least one sensor in the wellbore operation system while the bottom hole assembly is in the wellbore. The method further includes generating, by a processing device, a steering proposal based at least in part on the well plan and the well data. The method further includes drilling, with the wellbore operation system, at least a portion of the wellbore based at least in part on the steering proposal.

A non-limiting example system includes a wellbore operation system including a bottom hole assembly disposed in a wellbore. The system further includes a sensor in the wellbore operation system configured to generate well data related to a wellbore operation while the bottom hole assembly is in the wellbore. The system further includes a processing system comprising a memory and a processor, the processing system executing computer readable instructions to perform operations. The operations include generating a steering proposal based at least in part on a well plan for the wellbore operation and the well data. The operations further include controlling the bottom hole assembly based at least in part on the steering proposal.

Other embodiments of the present invention implement features of the above-described method in computer systems and computer program products.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

Referring now to the drawings wherein like elements are numbered alike in the several figures.

DETAILED DESCRIPTION

Modern bottom hole assemblies (BHAs) are composed of several distributed components, such as sensors and tools, with each component performing data acquisition and/or processing of a special purpose.

Figure 1:
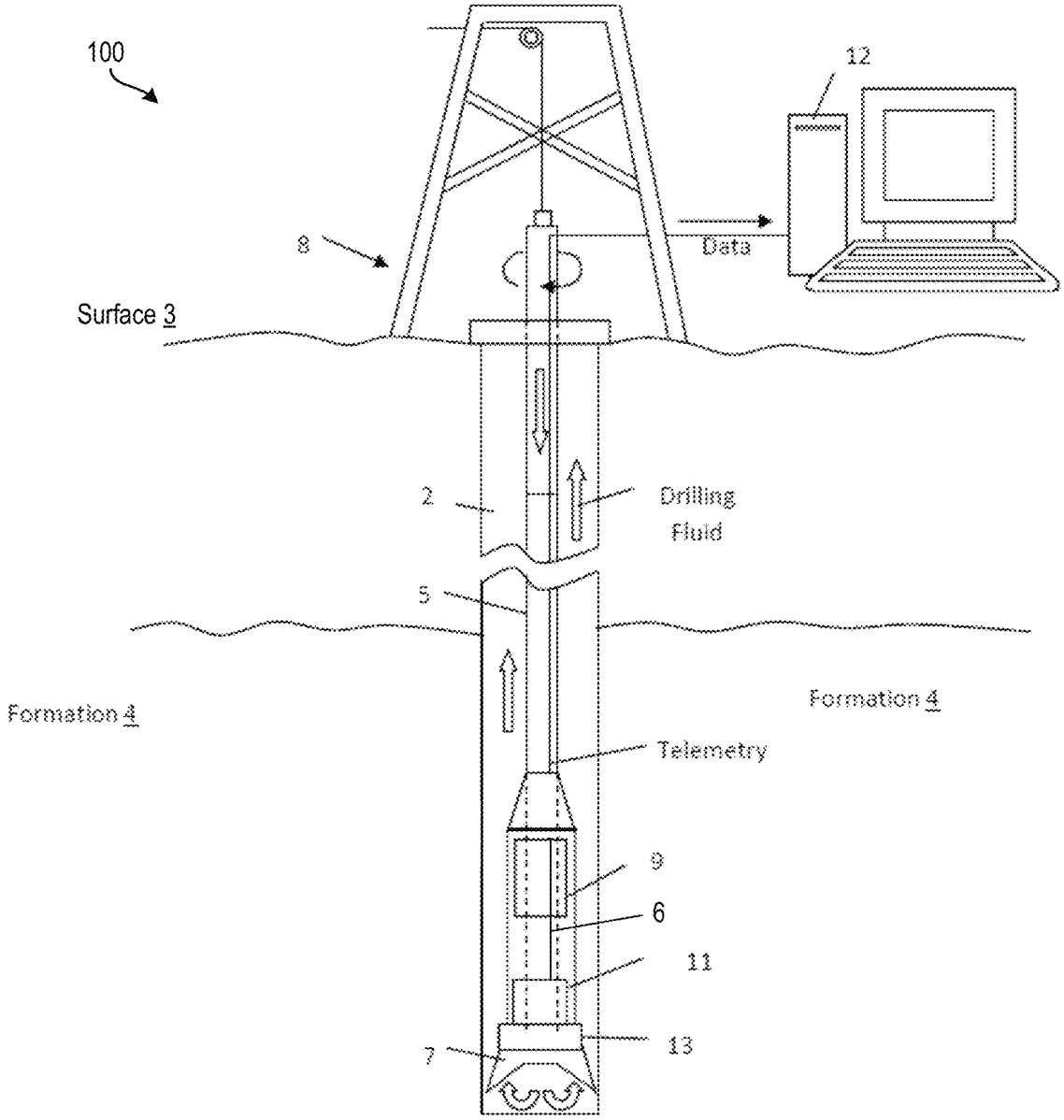
FIG. 1 depicts a cross-sectional view of a wellbore operation system according to one or more embodiments described herein.

Wellbores are drilled into a subsurface to produce hydrocarbons and for other purposes. In particular, FIG. 1 depicts a cross-sectional view of a wellbore operation system 100, according to aspects of the present disclosure. In traditional wellbore operations, logging-while-drilling (LWD) measurements are conducted during a drilling operation to determine formation rock and fluid properties of a formation 4. Those properties are then used for various purposes such as estimating reserves from saturation logs, defining completion setups, etc. as described herein.

The system and arrangement shown in FIG. 1 is one example to illustrate the downhole environment. While the system can operate in any subsurface environment, FIG. 1 shows a carrier 5 disposed in a borehole 2 penetrating the formation 4. The carrier 5 is disposed in the borehole 2 at a distal end of the borehole 2, as shown in FIG. 1.

As shown in FIG. 1, the carrier 5 is a drill string that includes a bottom hole assembly (BHA) 13. The BHA 13 is a part of the operation system 100 and includes drill collars, stabilizers, reamers, and the like, and the drill bit 7 (or "bit"). In examples, the drill bit 7 is disposed at a forward end of the BHA 13. The BHA 13 also includes sensors (e.g., measurement tools 11) and electronic components (e.g., downhole electronic components 9). The measurements collected by the measurement tools 11 can include measurements related to drill string operations, for example. BHA 13 also includes a steering tool (not shown)—also referred to as steering unit—configured to steer BHA 13 and drill bit 7 into a desired direction. The steering tool may receive steering commands (also referred to as BHA steering commands) based on which it creates steering forces (such as steering forces on steering pads of the steering tool sometimes also referred to as steer force) to push or point drill bit 7 into the desired direction. Notably, the number of steering commands that the steering tool is configured to act on is limited and the steering commands that can be used depend on the steering tool that is included in BHA 13. That is, there are various variants of steering tools that have different capabilities and limitations and different steering commands are defined that can be received and/or processed by the various variants of steering tools to cause the desired action in response to sending the steering commands to the steering tool. Also, for different variants of steering tools, different downhole control modes (e.g. inclination/azimuth hold, constant build/turn rate) may be available. In a similar way, there are various variants of BHAs depending on the variants of downhole tools (e.g., steering tool, measurement tools 11, drill bit 7, etc.) and the way they are assembled in BHA 13. The various BHA variants also have different capabilities and limitations, such as different steering capabilities. For example, while one BHA may be configured to achieve and withstand a build rate of 15°/100 ft another BHA variant may only be able to achieve or withstand a build rate of 8°/100 ft. An adaptive trajectory control framework needs to be able to work with different variants of BHAs and steering tools. Operation system 100 is configured to conduct drilling operations such as rotating the drill string and, thus, the drill bit 7. A drilling rig 8 also pumps drilling fluid through the drill string or carrier 5 in order to lubricate the drill bit 7 and flush cuttings from the borehole 2. The measurement tools 11 and downhole electronic components 9 are configured to perform one or more types of measurements in an embodiment known as logging-while-drilling (LWD) or measurement-while-drilling (MWD) according to one or more embodiments described herein.

Raw data is collected by the measurement tools 11 and transmitted to the downhole electronic components 9 for processing. The data can be transmitted between the measurement tools 11 and the downhole electronic components 9 by an electrical conduit 6, such as a wire (e.g. a powerline) or a wireless link, which transmits power and/or data between the measurement tools 11 and the downhole electronic components 9. Power may be generated downhole by a turbine-generation combination (not shown) or a battery (not shown), and communication to the surface 3 (e.g., to a processing system 12) may be cable-less (e.g., using mud pulse telemetry, electromagnetic telemetry, etc.) and/or cable-bound (e.g., using a cable to the processing system 12, e.g. by wired pipes). The data processed by the downhole electronic components 9 can then be telemetered to the surface 3 for additional processing or display by the processing system 12.

Drilling control signals can be generated by the processing system 12 (e.g., at the surface 3 and based on the raw data collected by the measurement tools 11) and conveyed downhole or can be generated within the downhole electronic components 9 or by a combination of the two according to embodiments of the present disclosure. The downhole electronic components 9 and the processing system 12 can each include one or more processors and one or more memory devices. In alternate embodiments, computing resources such as the downhole electronic components 9, sensors, and other tools can be located along the carrier 5 rather than being located in the BHA 13, for example. The borehole 2 can be vertical as shown or can be in other orientations/arrangements (see, e.g., FIG. 5A, FIG. 5B).

Figure 2:
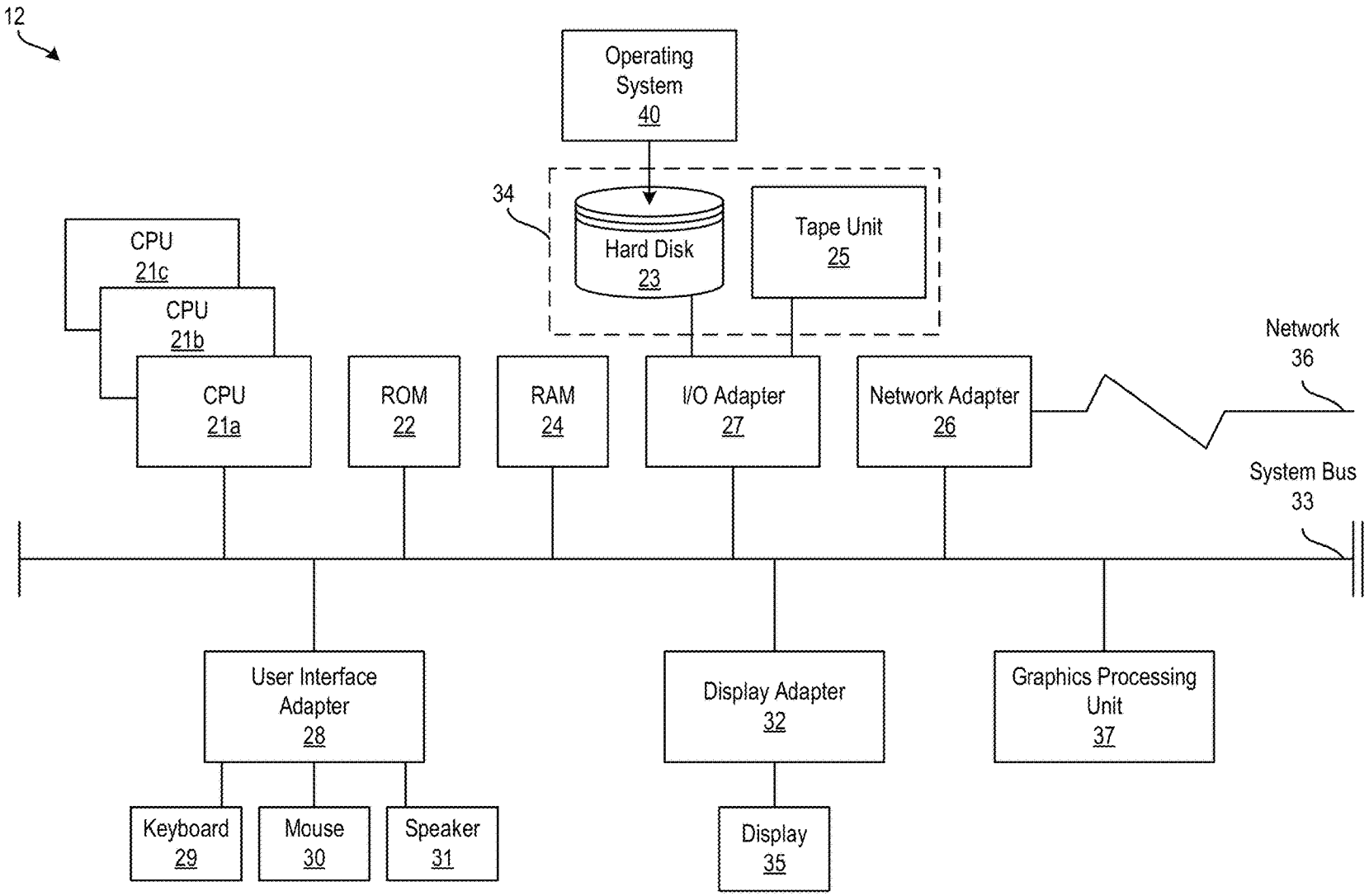
FIG. 2 depicts a block diagram of the processing system of FIG. 1, which can be used for implementing the present techniques herein according to one or more embodiments described herein.

It is understood that embodiments of the present disclosure are capable of being implemented in conjunction with any other suitable type of computing environment now known or later developed. For example, FIG. 2 depicts a block diagram of the processing system 12 of FIG. 1, which can be used for implementing the techniques described herein. In examples, processing system 12 has one or more central processing units 21*a*, 21*b*, 21*c*, etc. (collectively or generically referred to as processor(s) 21 and/or as processing device(s) 21). In aspects of the present disclosure, each processor 21 can include a reduced instruction set computer (RISC) microprocessor. Processors 21 are coupled to system memory (e.g., random access memory (RAM) 24) and various other components via a system bus 33. Read only memory (ROM) 22 is coupled to system bus 33 and can include a basic input/output system (BIOS), which controls certain basic functions of processing system 12.

Further illustrated are an input/output (I/O) adapter 27 and a network adapter 26 coupled to system bus 33. I/O adapter 27 can be a small computer system interface (SCSI) adapter that communicates with a memory, such as a hard disk 23 and/or a tape storage device 25 or any other similar component. I/O adapter 27 and memory, such as hard disk 23 and tape storage device 25 are collectively referred to herein as mass storage 34. Operating system 40 for execution on the processing system 12 can be stored in mass storage 34. The network adapter 26 interconnects system bus 33 with an outside network 36 enabling processing system 12 to communicate with other systems.

A display (e.g., a display monitor) 35 is connected to system bus 33 by display adaptor 32, which can include a graphics adapter to improve the performance of graphics intensive applications and a video controller. In one aspect of the present disclosure, adapters 26, 27, and/or 32 can be connected to one or more I/O busses that are connected to system bus 33 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 33 via user interface adapter 28 and display adapter 32. A keyboard 29, mouse 30, and speaker 31 can be interconnected to system bus 33 via user interface adapter 28, which can include, for example, a Super I/O chip integrating multiple device adapters into a single integrated circuit.

In some aspects of the present disclosure, processing system 12 includes a graphics processing unit 37. Graphics processing unit 37 is a specialized electronic circuit designed to manipulate and alter memory to accelerate the creation of images in a frame buffer intended for output to a display. In general, graphics processing unit 37 is very efficient at manipulating computer graphics and image processing and has a highly parallel structure that makes it more effective than general-purpose CPUs for algorithms where processing of large blocks of data is done in parallel.

Thus, as configured herein, processing system 12 includes processing capability in the form of processors 21, storage capability including system memory (e.g., RAM 24 and mass storage 34), input means such as keyboard 29 and mouse 30, and output capability including speaker 31 and display 35. In some aspects of the present disclosure, a portion of system memory (e.g., RAM 24 and mass storage 34) collectively store an operating system to coordinate the functions of the various components shown in processing system 12.

One or more embodiments described relate to automated directional drilling and particularly to adaptive trajectory control for automated directional drilling using an adaptive control framework. Directional drilling is typically a manual process, which relies on monitoring drilling parameters and trends, predicting a future wellbore trajectory, and adjusting steering parameters to provide for adherence to a well plan. When drilling with a rotary steerable system (RSS) for example, trajectory control is distributed between the surface (e.g., using the processing system 12) and downhole (e.g., using the downhole electronic components 9). The surface control component (e.g., the processing system 12) utilizes downhole measurements and knowledge of the capabilities of the BHA (e.g., the BHA 13) to generate commands for the downhole tool. Conventionally, the directional driller is responsible for surface control. Recent progress in drilling automation has attempted to unburden the directional driller by introducing computerized trajectory advisory/control systems. However, these systems struggle to cope with the broad variety of trajectory control scenarios, which may lead to poor performance in some situations. Furthermore, approaches which rely too heavily on physics-based models suffer from high uncertainty and the inability to estimate the many drilling parameters in real-time. Further, in some cases, such approaches provide only limited control or prediction horizon, which may result in aggressive behavior and too many downlinks.

One or more embodiments described herein address these and other shortcomings of the prior art by providing an adaptive control framework for adaptive trajectory control for automated directional drilling. For example, the adaptive control framework takes as input various data (e.g., a well plan, drilling data, survey data, actual steering parameters of the BHA, list or collection of possible steering commands, etc.) and generates a steering proposal (e.g., steering setpoints). The adaptive control framework can be implemented at the surface or downhole to provide for surface-based and/or downhole-based control of a BHA. The adaptive trajectory control framework generates a steering proposal that is tailored to each directional drilling scenario for different drilling systems, such as RSS BHAs including RSS BHAs with a downhole motor and bent motor BHAs (i.e., BHAs including a downhole motor with pre-defined bend that will create build or walk forces and therefore a borehole curvature when the drill bit is rotated by the downhole motor). In one or more embodiments, the adaptive control framework can be extended to other applications for drilling optimization, such as rate-of-penetration (ROP) optimization and hole cleaning optimization, as well as other possible applications and combinations thereof. For example, the framework can be used to provide a trajectory optimized for surface drilling parameters such as ROP and downhole drilling parameters.

According to one or more embodiments described herein, the adaptive control framework detects a control scenario in real-time (or near-real-time), automatically selects one or more control engines suitable for the scenario, and generates a steering proposal using the selected one or more control engines to cause a BHA to follow a predetermined trajectory. According to one or more embodiments described herein, the adaptive control framework provides a real-time (or near-real-time) trajectory optimization scheme that generates optimal build and turn rate and azimuth and inclination hold setpoints to adhere to the well plan.

Figure 3:
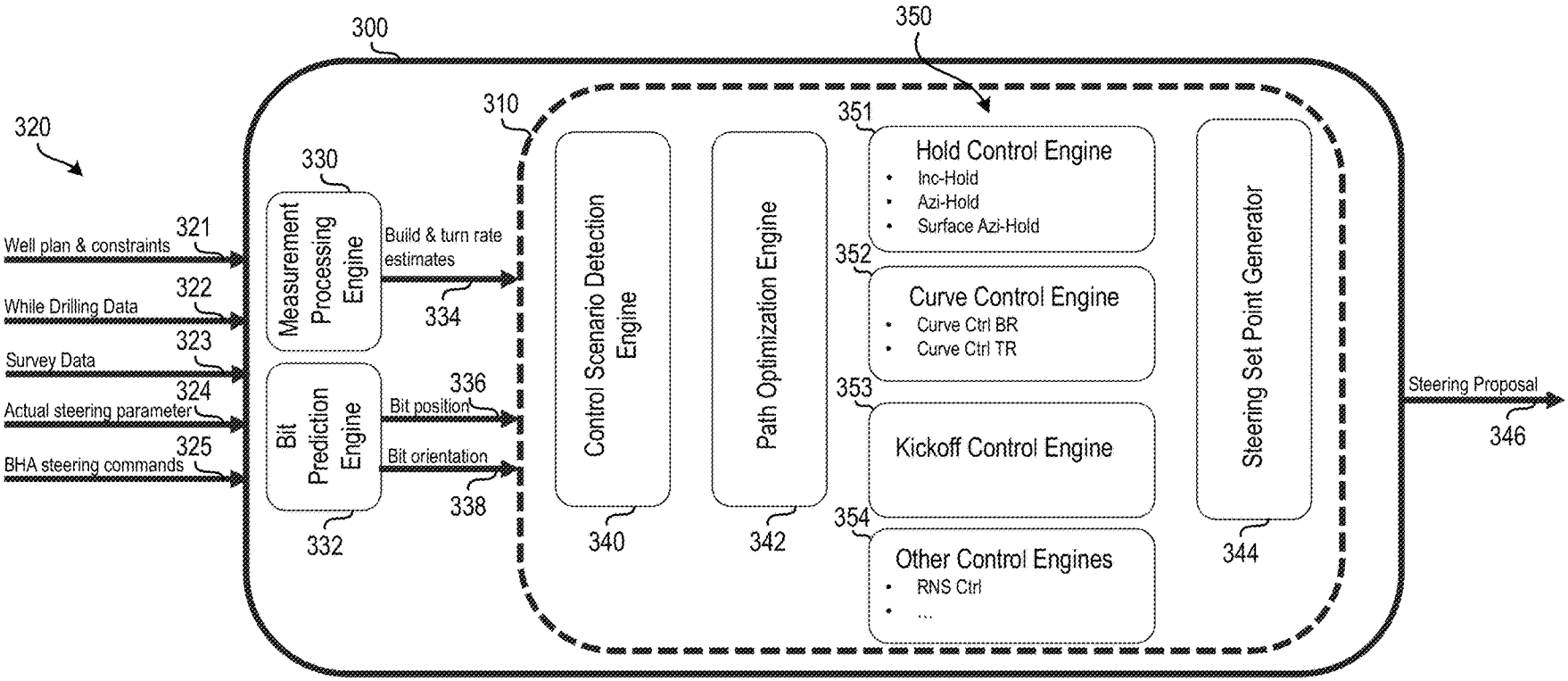
FIG. 3 depicts a trajectory control system including an adaptive trajectory control framework according to one or more embodiments described herein.

FIG. 3 depicts a trajectory control system 300 including an adaptive trajectory control framework 310 according to one or more embodiments described herein. The trajectory control system 300 can be embedded in a closed-loop control system (see, e.g., FIGS. 4A, 4B) as described herein. The trajectory control system 300 can utilize a surface system (e.g., the processing system 12) and/or downhole controllers (e.g., the downhole electronic components 9) to steer the BHA such that it adheres to a predefined trajectory (also referred to as a "well plan").

The various components, modules, engines, etc. described regarding FIG. 3 can be implemented as instructions stored on a computer-readable storage medium, as hardware modules, as special-purpose hardware (e.g., application specific hardware, application specific integrated circuits (ASICs), application specific special processors (ASSPs), field programmable gate arrays (FPGAs), as embedded controllers, hardwired circuitry, etc.), or as some combination or combinations of these. According to aspects of the present disclosure, the engine(s) described herein can be a combination of hardware and programming. The programming can be processor executable instructions stored on a tangible memory, and the hardware can include a processing device (e.g., the processing device 21 of FIG. 2) for executing those instructions. Thus a system memory (e.g., the RAM 24 of FIG. 2) can store program instructions that when executed by the processing device implement the engines described herein. Other engines can also be utilized to include other features and functionality described in other examples herein.

The trajectory control system 300 uses data 320 to generate a steering proposal 346, which is implemented to control the BHA 13. The steering proposal 346 (which can be expressed, for example, as steering setpoints) could include, for example, a BHA steering command and set points, for example for parameters measured on surface (e.g., weight on bit (WOB), ROP, and drill string rotational velocity, such as revolutions per minute (RPM)) or parameters measured downhole (e.g. directional data, such as inclination, azimuth, or toolface). The features and functions of the trajectory control system 300 are now further described.

The trajectory control system 300 receives data 320, which can include one or more of well plan and constraints 321 (or simply "well plan 321"), while drilling data 322 (e.g., data measured or collected while drilling including directional data collected while drilling, such as continuous inclination or continuous azimuth), survey data 323 (i.e. directional data, such as inclination, azimuth, and toolface that is collected while the drilling process is interrupted), actual steering parameters 324 (i.e. steering parameters that are currently used by the steering tool), and/or actual steering commands 325 (i.e. last steering commands that were sent to the steering tool) for steering the BHA 13. The trajectory control system 300 processes the data 320 using a measurement processing engine 330 and a bit prediction engine 332. Particularly, the measurement processing engine 330 processes the data 320, such as while drilling data 322 and/or survey data 323 to determine build and turn rate estimates 334. The build rate (sometimes also referred to as build-up rate) is the change in inclination of the borehole over a particular length of the well trajectory expressed as degrees/length. The turn rate is the gradient of the borehole direction, i.e. the change of azimuth of the borehole in the horizontal plane over a particular length of the well trajectory expressed as degrees/length. The bit prediction engine 332 estimates or predicts a bit position 336 (also referred to as a "predicted bit position") and a bit orientation 338 (also referred to as a "predicted bit orientation"). Typically, the actual bit position and the actual bit orientation cannot be measured directly. Therefore, bit position and orientation need to be estimated or predicted, e.g. by using while drilling data 322 and/or survey data 323. The predicted bit position 336 represents the location of the drill bit 7 (e.g., expressed as coordinates (x,y,z)) while the predicted bit orientation 338 represents the orientation of the drill bit 7 at the predicted bit position 336 (e.g., expressed in terms of one or more of azimuth, inclination, and toolface and/or one or more of pitch, roll, and yaw). Together, the predicted bit position 336 and the predicted bit orientation 338 define the freedom of movement of the drill bit 7 in three-dimensional space (e.g., 6 degrees of freedom (6DoF)).

For example, the trajectory control system 300 receives the well plan and constraints 321, as well as the actual steering parameters 324 and the actual steering commands 325. Steering commands 325 could be a list or collection of steering commands, which can be transmitted (e.g. downlinked) to a steering tool and which the steering tool is configured to process and cause a steering action in response to receiving the steering commands. The steering commands 325 are analyzed and the steering capabilities are derived. The steering capabilities can include the list of available steering commands for the selected BHA including the selected steering tool. Steering capabilities can also include a set of modeled or predicted wellbore trajectories. For example, the steering action that would be caused by a specific steering command could be fed in a model of the steering process to determine how the BHA would react in response to the specific steering command being sent to the steering tool. This allows to model or predict the trajectory of the wellbore in response to sending one or more steering commands According to an embodiment, since modeling is always associated with some uncertainty that increases with the length of the modelled trajectory, only a preselected length (also referred to as prediction horizon) of the wellbore will be modelled. If steering commands include simple instructions referring to the geometric curvature of the wellbore trajectory (e.g., inclination hold which is the steering command to achieve and hold a specified inclination value, azimuth hold which is the steering command to achieve and hold a specified azimuth value, constant turn rate which is the steering command to achieve and hold a specified turn rate, constant build rate which is the steering command to achieve and hold a specified build rate), the model of the steering process can be a simple geometrical model that predicts the trajectory of the wellbore starting from a known position downhole. For example, the simple geometrical model would not require to solve differential equations like it is oftentimes the case in physics-based models. Consequently, physics-based modeling is time consuming, and suffers from high uncertainty and the inability to estimate the required input parameters for the physics-based model in real-time. Further, in some cases, physics-based models or models that require to solve differential equations in real-time provide only a limited or relatively short prediction horizon, which may result in an undesired aggressive behavior of the BHA and too many downlinks. Modeling or predicting the trajectory of the wellbore in response to sending one or more steering commands to the steering tool that would cause a steering action by the steering tool, leads to a collection of optional BHA reactions or optional wellbore trajectories that can be achieved with the steering commands 325 and that may be part of the steering capabilities. Steering capabilities could also be one or more discrete setpoints or a range of setpoints, some of which may be modelled points of a predicted well path or trajectory. For example, if the steering tool is a bent motor, steering capabilities could be a range for the drill string revolutions per minute (RPM), discrete setpoints for rotating/sliding and one or more setpoint range for the BHA's toolface. The transformation of steering commands into steering capabilities allows the trajectory control system 300 to be agnostic and/or adaptive to the steering tool and the BHA used. Out of the steering capabilities, one or more steering commands can be chosen that would be best suited to follow a well plan or a working plan and that will be communicated to the steering tool as will be described in more detail below. For example, choosing one or more steering commands may be achieved by optimizing (e.g. minimizing or maximizing) a cost function that depends on the modelled trajectory of the wellbore in response to sending one or more steering commands to the steering tool and that considers one or more of expected dogleg severities, bending moments, and other factors affecting wear and/or reliability aspects of the modelled wellbore trajectories, as well as number of required downlinks or other times with no drilling progress and/or expected time to drill the modelled wellbore trajectories.

The adaptive trajectory control framework 310 uses the results of the processed data 320 (e.g., the build and turn rate estimate 334, the predicted bit position 336, and the predicted bit orientation 338) to select a control scenario from a plurality of control scenarios using the control scenario detection engine 340. For example, the well plan is analyzed, and its constraints are derived, such as associated 3D corridor constraints based on the allowed drilling corridor, planned targets, as well as offset wells. The bit state (e.g., the predicted bit position 336 and the predicted bit orientation 338) is continuously predicted by the bit prediction engine 332. The bit state prediction is based on real-time measurements that may include continuous inclination and continuous azimuth measurements (i.e. directional data that are taken while the drilling process continues, such as while the BHA 13 is rotating with weight on bit >0, e.g., as part of the while drilling data 322) and the survey data 323 (i.e. directional data that are taken while the drilling process stops, such as while the BHA 13 is non-rotating and/or weight on bit is zero or negative, e.g., as part of the survey data 323). The build and turn rate estimates may be also continuously estimated based on continuous inclination and continuous azimuth measurements (e.g., the while drilling data 322), a real-time estimation of their variances, and the survey data 323.

The path optimization engine 342 determines a "working plan" that may be determined or optimized based on the current bit state (e.g., the predicted or estimated bit position 336 and the predicted or estimated bit orientation 338), survey data 323 (e.g., deepest survey data), and the well plan and constraints 321. The working plan is a modified well plan to steer the BHA back to the well plan 321 or follow the well plan 321 within a given prediction horizon. A description of how the working plan is determined is further described herein and is referred to as "path optimization".

Next, control engines 350 are designed to achieve the desired setpoint derived through path optimization of the working plan. The control engines 350 include one or more control engines for performing desired tasks, such as a hold control engine 351, a curve control engine 352, a kickoff control engine 353, and/or other control engines 354. The control engines 350 derive control actions to perform the desired tasks. Control actions may be feedback controls or closed loop control actions to achieve and hold a predefined setpoint. That is, during the hold control action of a selected parameter, the actual parameter value may be measured and compared with the predefined setpoint of the parameter. Based on the deviation (e.g. difference) between predefined setpoint of the parameter and the measured actual parameter values, steering parameters (e.g. steering forces) of the steering tool will be adjusted to reduce the deviation between predefined setpoint of the parameter and the measured actual parameter value. For example, the inclination hold control action may be a closed loop control action to achieve and hold the inclination value at a predefined inclination setpoint. That is, during the inclination hold control action, the actual inclination may be measured and compared with the predefined inclination setpoint. Based on the deviation (e.g. difference) between predefined inclination setpoint and measured actual inclination, steering forces of the steering tool will be adjusted to reduce the deviation between predefined inclination setpoint and measured actual inclination. According to an example, the control actions are separated into build and walk directions and are addressed independently. The control engines 350 and their activation strategies are further described herein and may be referred to as "activation of control engines." In the case of an RSS BHA, the control actions are combined into the steering proposal 346 based on the available steering commands, which is further described herein and referred to as "generation of steering set points" and is performed by the steering set point generator 344. According to one or more embodiments described herein, a two-step approach to evaluate setpoint changes is designed to reduce the number of downlinks. For example, in the first step at a first time, the trajectory control system 300 may flag that a new setpoint is available and in the second step at a second time, the trajectory control system 300 transforms the setpoint proposal 346 into a downlink command within a downlink creator component (not shown). The downlink creator component considers the operational situation to decide when to downlink (e.g., when the next stand will be added, i.e. when the drilling process will be temporarily interrupted to add one or more drill pipes to carrier 5, to assure that the additional interruption of the drilling process required to send the downlink will be minimal or zero). In the case of a bent motor BHA the steering proposals are submitted to the rig control system (e.g., the processing system 12).

Figure 4A:
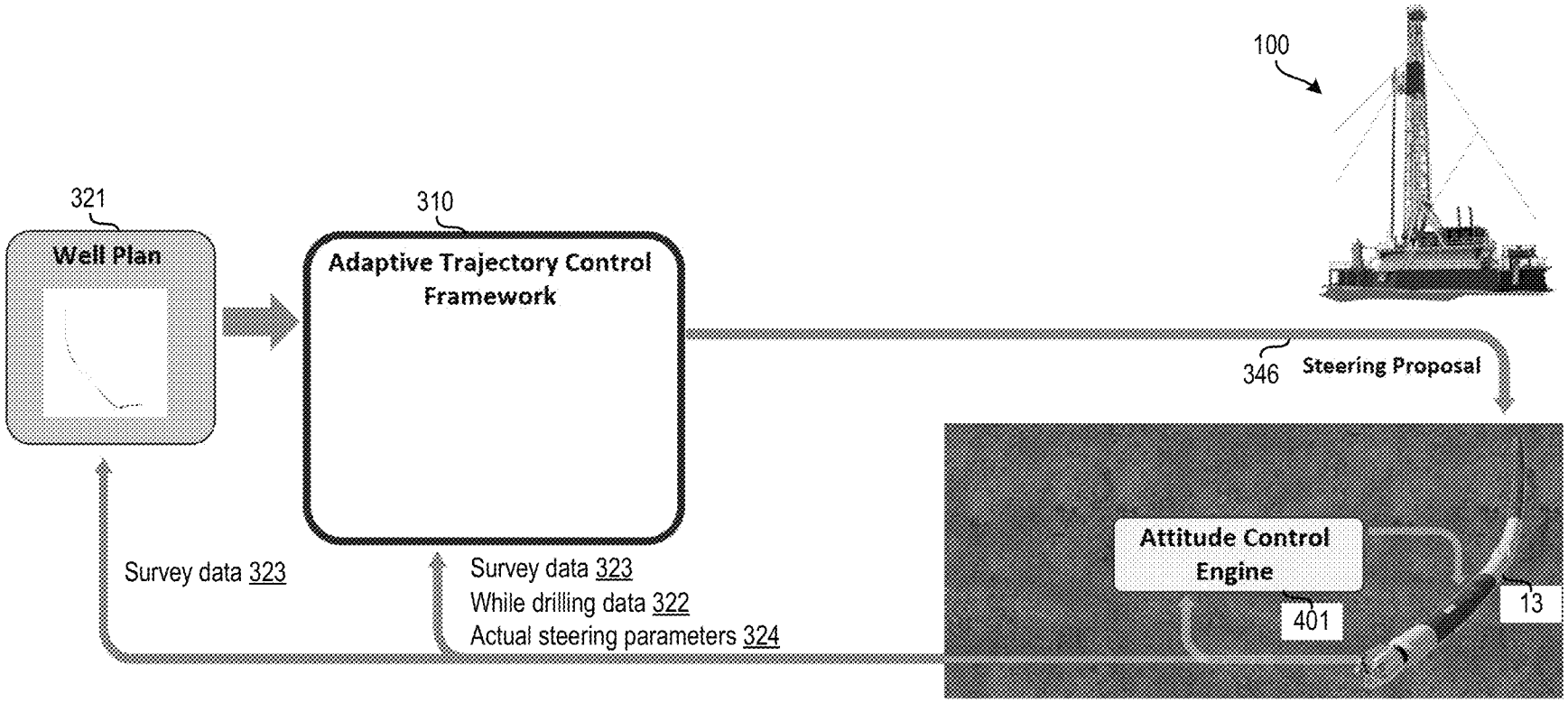
FIG. 4A depicts the adaptive trajectory control framework of FIG. 3 implemented at the surface according to one or more embodiments described herein.
Figure 4B:
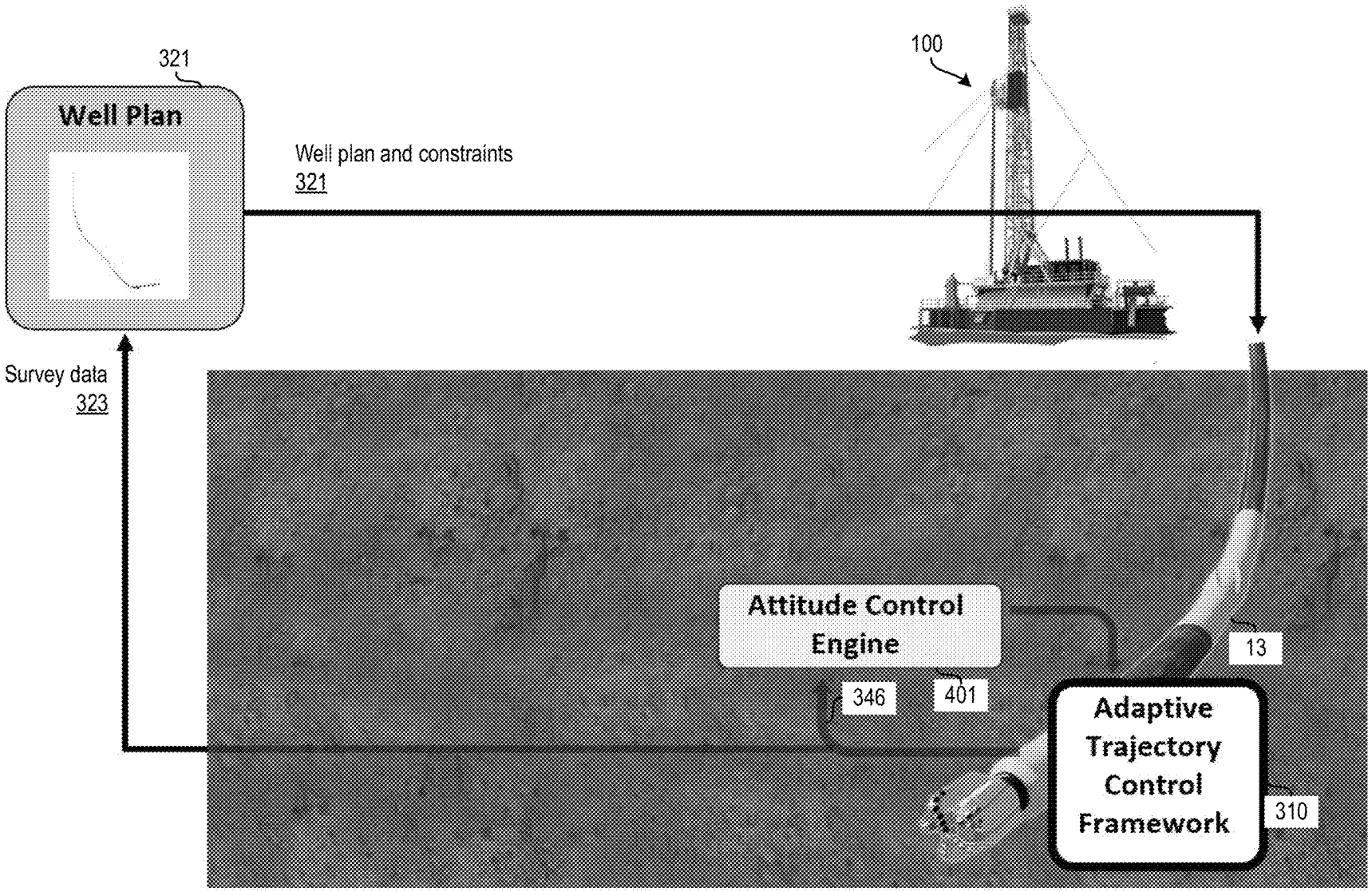
FIG. 4B depicts the adaptive trajectory control framework of FIG. 3 implemented downhole according to one or more embodiments described herein.

The adaptive trajectory control framework 310 of FIG. 3 can be implemented at the surface 3 (e.g., using the processing system 12) and/or in the borehole 2 (e.g., using the downhole electronic components 9). Two implementation examples are depicted in FIGS. 4A and 4B. Particularly, FIG. 4A depicts the adaptive trajectory control framework 310 of FIG. 3 implemented at the surface 3 according to one or more embodiments described herein. FIG. 4B depicts the adaptive trajectory control framework 310 of FIG. 3 implemented downhole (e.g., in the borehole 2) according to one or more embodiments described herein. In other embodiments, parts of the adaptive trajectory control framework 310 may be implemented at the surface 3 and other parts of the adaptive trajectory control framework 310 may be implemented downhole. The implementations shown in FIGS. 4A and 4B are now further described.

With reference to both FIGS. 4A and 4B, the wellbore operation system 100 is shown. The wellbore operation system 100 can utilize any suitable BHA (e.g., the BHA 13), which may include an RSS BHA, a bent motor BHA, or the like.

In FIG. 4A, the adaptive trajectory control framework 310 is implemented at the surface 3 (e.g., at a rig site, such as the wellbore operation system 100). In this example, the functions of the adaptive trajectory control framework 310 are performed by the processing system 12 or another suitable system/device location at the surface 3. The processing system 12 communicatively connected to a rig network (not shown) that is used to transmit/receive signals to/from the BHA 13, for example, using mud-pulse or EM telemetry. Using this form of deployment of the adaptive trajectory control framework 310 is advantageous in that depth information that is measured at the surface is easily available and can be transmitted to the trajectory control system 300. The well plan 321 and any further well plan updates can be fed directly into the adaptive trajectory control framework 310 as shown and are not limited by the low-bandwidth telemetry channel of the rig network. Furthermore, the measurement of relevant surface adjustable drilling parameters such as depth, ROP or drill string RPM can be fed into the adaptive trajectory control framework 310 as shown. According to one or more embodiments, downhole measurements and applied steering parameters are received from the BHA 13. In an example using wired-pipe telemetry, the bandwidth limitation for downhole data is reduced/eliminated and the adaptive trajectory control framework 310 can exert full control without suffering from long delays through the mud-pulse or EM telemetry channel. Furthermore, when deploying the adaptive trajectory control framework 310 at the surface 3, processing power is easier to scale to the application needs as compared to a downhole implementation. Communication with other applications can be established using standardized communication protocols such as Open Platform Communications United Architecture (OPC-UA). If extensive processing power is needed (e.g., for the calculation of the path optimization), cloud computing could be utilized. The deployment of the adaptive trajectory control framework 310 at the rig site is advantageous for automation of the directional drilling process as it takes the bandlimited and costly communication with the downhole BHA 13 into account and provides for access to surface and downhole controllable drilling parameters. This implementation also provides for gradual evolution in the directional drilling workflows as it reflects the tasks a directional driller is doing manually in conventional implementations. The BHA 13 can implement some control engines, such attitude control engine 401 (e.g., in conjunction with the downhole electronic components 9) to implement a steering proposal 346 received from the adaptive trajectory control framework 310, which, in this example, is located at the surface 3. For example, the BHA 13 can implement control engines to implement one or more steering proposals 346 received from the adaptive trajectory control framework 310 that includes control modes that can be executed solely downhole (i.e. downhole control modes, such as, but not limited to, inclination/azimuth hold modes or constant build/turn rate). The adaptive trajectory control framework 310 can also provide the possibility to automatically revert back from a downhole control mode to the surface control mode in case it detects that the measurement quality of one or more downhole measurements is corrupted or insufficient quality. For example, the adaptive trajectory control framework 310 can provide the possibility to automatically revert back from the downhole azimuth hold function to the surface feedback control function in case it detects that the measurement quality of the downhole azimuth used for downhole control is corrupted or insufficient, while the quality of a different sensor is still sufficient. To detect that measurement quality of a measurement is of sufficient quality, measurement quality parameters (e.g., noise, drift, etc.) and corresponding measurement quality parameter thresholds are defined. The measurement quality parameters can be monitored and an action can be triggered, such as an alarm or reverting back from a downhole control mode to a surface control mode, once the threshold is exceeded.

In another embodiment, as shown in FIG. 4B, the adaptive trajectory control framework 310 can be deployed within a steering tool (e.g., one of the downhole electronic components 9) of the BHA 13. In this embodiment, sensor readings from a near-bit-azimuth sensor (e.g., one of the measurement tools 11) or near-bit-inclination sensor (e.g., one of the measurement tools 11) are fed into the adaptive trajectory control framework 310. In some examples, the adaptive trajectory control framework 310 is equipped with the well plan 321 prior to a run. Possible well plan updates can be transmitted to the BHA 13 via telemetry updates (e.g. mud-pulse telemetry, electromagnetic telemetry, wired-pipe telemetry, etc.). Relative depth information can also be provided to the BHA, e.g. via dual inclination methods or transmitted via the downlink telemetry channel Steering parameters and steering capability information are available in the downhole steering tool of the BHA 13. The adaptive trajectory control framework 310 has access to the attitude control engine of the BHA 13. In some examples, the attitude control engine 401 can be considered as part of the adaptive trajectory control framework 310. The adaptive trajectory control framework 310 can implement the steering proposal 346 received from the adaptive trajectory control framework 310, which, in this example, is downhole in the BHA 13.

With continued reference to FIG. 3, the features and functions of the adaptive trajectory control framework 310 are now further described.

The adaptive trajectory control framework 310 can process many different directional drilling scenarios. These scenarios are derived based on the planned build rates (BUR), turn rates (TR), and orientation (inclination and azimuth) of the well plan 321. The well plan 321 could be either the reference trajectory provided at the start of the run or updated during the run, or an optimized "working plan" which has been calculated to return to the reference trajectory. An example table of control scenarios, with associated conditions, are summarized as follows:

| Control Scenario | Condition |
|---|---|
| Build/Drop | BUR ≠ 0 |
| Turn Left/Right | TR ≠ 0 |
| Constant inclination | BUR = 0 and inclination > 0 |
| Constant azimuth | TR = 0 |
| Vertical | BUR = 0 and inclination = 0 |
| 3D | BUR ≠ 0 and TR ≠ 0 |

Real-time (or near real-time) control scenario detection is now described. For example, using the control scenario detection engine 340 and the path optimization engine 342, the adaptive trajectory control framework 310 detects the control scenario using the well plan 321 (e.g., planned trajectory or "working plan") and the estimated position (and/or orientation) of the drill bit 7. Two approaches to control scenario detection are now described: static control scenario detection and dynamic control scenario detection.

Figure 5A:
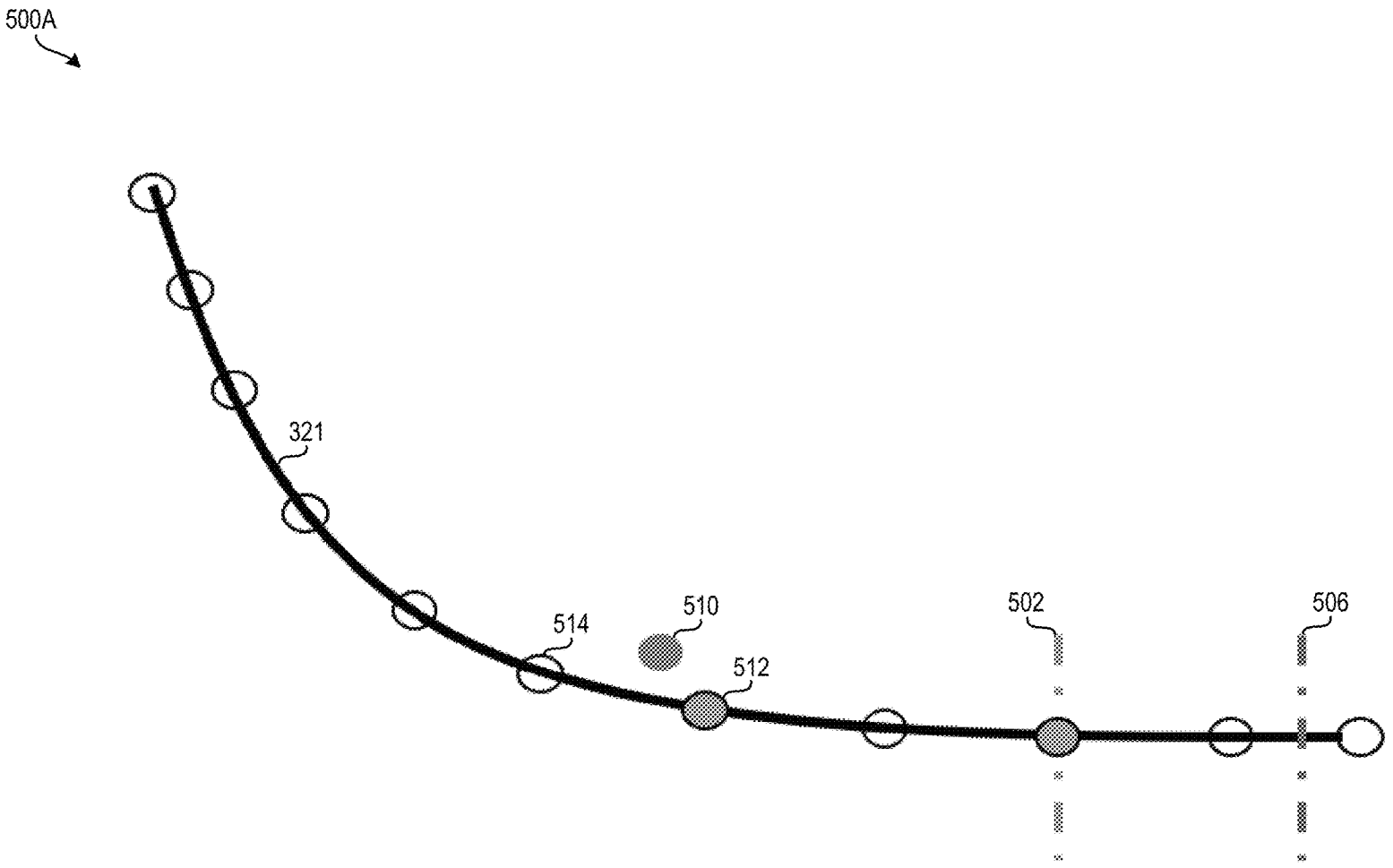
FIG. 5A depicts a graph of a well plan having a section change within a prediction horizon according to one or more embodiments described herein.
Figure 5B:
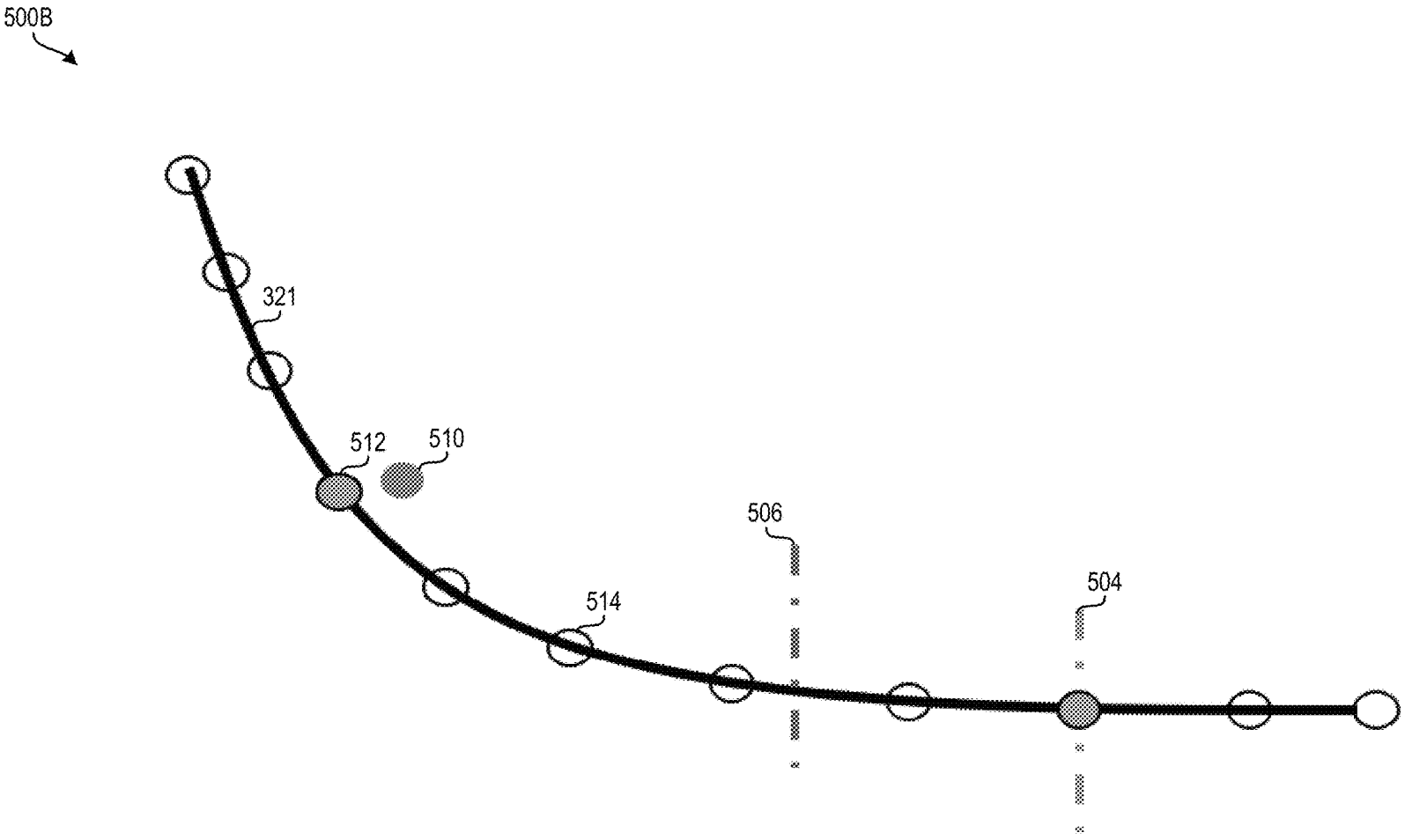
FIG. 5B depicts a graph of the well plan having a section change outside a prediction horizon according to one or more embodiments described herein.

Using static control scenario detection, the control scenario can be determined by considering the well plan. In this case, the estimated or predicted bit position 336 is used to find a nearest point on the well plan 321. A next planned section change in build and walk direction is identified in the remainder of the well plan 321, see, e.g., FIGS. 5A and 5B. In the context of this disclosure, a well plan 321 may be any mathematical representation of graphs 500A or 500B or portions or selected points of graphs 500A and 500B that represent the planned trajectory of the borehole in formation 4. For example, well plan 321 can be a list of coordinate values (such as x, y, z coordinates or north, east, depth coordinates or the like) that belong to points 514 of the well plan and that are suited to reconstruct graphs 500A/500B with sufficient resolution. Alternatively or in addition, the well plan may include algorithms (e.g. equations) that can be used to calculate corresponding coordinate values to localize a point of the well plan 321 (such as a function describing graphs 500A/500B, interpolation equations—e.g. spline functions, interpolation by polynoms or other functions—to interpolate well plan 321 between points 314 with known coordinate values to points where coordinate values are not provided, or extrapolation equations to extrapolate well plan 321 from points 314 with known coordinate values to points where coordinate values are not provided). Also, in the context of this disclosure, constraints of a well plan are mathematical constraints of well plan that limit the number of optional well plans that would be suitable otherwise. Examples for constraints of a well plan are a maximum dogleg severity of a well plan or a maximum distance from a well plan, defined no-go zones (e.g., defined no-go zones to prevent collision with other wells), defined drilling corridors, planned targets, etc. A section change (e.g., the section changes 502, 504) is depicted in each of FIGS. 5A and 5B. A section change is the point at which the drilling scenario transitions into another scenario (see example table of control scenarios for some scenarios). Accordingly, a section is the length interval of a drilled or modelled wellbore trajectory with a constant drilling scenario. For example, a build scenario can transition to a constant inclination scenario. Another example is that a turn scenario can transition to a constant azimuth scenario. Other examples are also possible. Particularly, FIG. 5A depicts a graph 500A of the well plan 321 having a section change 502 at a shorter distance to the 510 along the well plan 321 or the working plan than the prediction horizon 506 according to one or more embodiments described herein. FIG. 5B depicts a graph 500B of the well plan 321 having a section change 504 outside the prediction horizon 506 according to one or more embodiments described herein. In the graphs 500A, 500B, the point 510 represents an estimated or predicted bit position, and the point 512 represents a point which is closest to the point 510, also referred to as nearest point 512 on the well plan 321.

If the section change 502, 504 occurs within a defined distance (e.g., prediction horizon) from the nearest point (see, e.g., the point 512 of FIG. 5A), the control scenario is determined by the section change 502, 504. This provides for sufficient time to prepare the transition. Otherwise the control scenario is defined by the nearest point (see, e.g., the point 512 of FIG. 5B). The build rate and/or turn rate of the chosen point (the nearest point 512 or the section change 502, 504) on the well plan 321 determines the control scenario (e.g., vertical, build, drop, constant inclination, turn left, turn right, constant azimuth).

For a magnetic kick-off (i.e., an intentional deviation from a vertical well based on only magnetic directional data, such as without directional data from accelerometers, gravitometers), the distance to the chosen point is dynamically (i.e. not statically) defined and determined by the tool's ability to build inclination (e.g., nominal steerability parameter "nominalSteerability") and the planned build rate of the kickoff ("kickOffBuildRate"). The distance to the chosen point for a magnetic kick-off may be defined as:

$$\min\left(15\text{ m}, \max\left(\frac{15\text{ m}\cdot kickOffBuildRate}{nominalSteerability}, 0\right)\right)$$

where nominalSteerability is defined as the expected dogleg severity when drilling with a 100% steering force. This can be a user configuration based on the drilling experience collected for a specific field, for example. With continued reference to FIG. 3, the control scenario can also be determined dynamically with real-time trajectory optimization. In one or more embodiments, the estimated or predicted bit position 336 and estimated or predicted bit orientation 338 are used as a starting point for path optimization. In one or more other embodiments, the survey position and survey orientation (from the survey data 323) are used as a starting point. The path optimization engine 342 determines whether to introduce a section of constant build rate, turn rate, inclination, and/or azimuth, for example by optimizing (e.g., minimizing or maximizing) a cost function that depends on modelled trajectories of the wellbore in response to sending one or more steering commands to the steering tool and that considers one or more of expected dogleg severities, bending moments, and other factors affecting wear and/or reliability aspects of the modelled wellbore trajectories, as well as number of required downlinks or other times with no drilling progress and/or expected time to drill the modelled wellbore trajectories.

This gives the path optimization engine 342 the flexibility to correct for existing position and orientation errors in a suitable way independent of the planned control scenario and well plan section. This is now further described with reference to "path optimization."

Particularly, real-time (or near real-time) "path optimization" provides for one or more working plans and/or one or more setpoints, setpoint range, or control modes to ensure that a drilled trajectory remains on/close to or steers back to the predefined well plan 321. This includes any adjustments to bring the drill bit 7 back to the well plan in the event of a disturbance (e.g., a change in formation or any parameter that may cause a deviation of the actual trajectory from the well plan 321). Path optimization was developed under the following assumptions: the control engines 350 are available for adhering to the optimized trajectory (the control engines 350 do not need knowledge of downhole dynamics), and the well plan is the desired trajectory.

Figure 6:
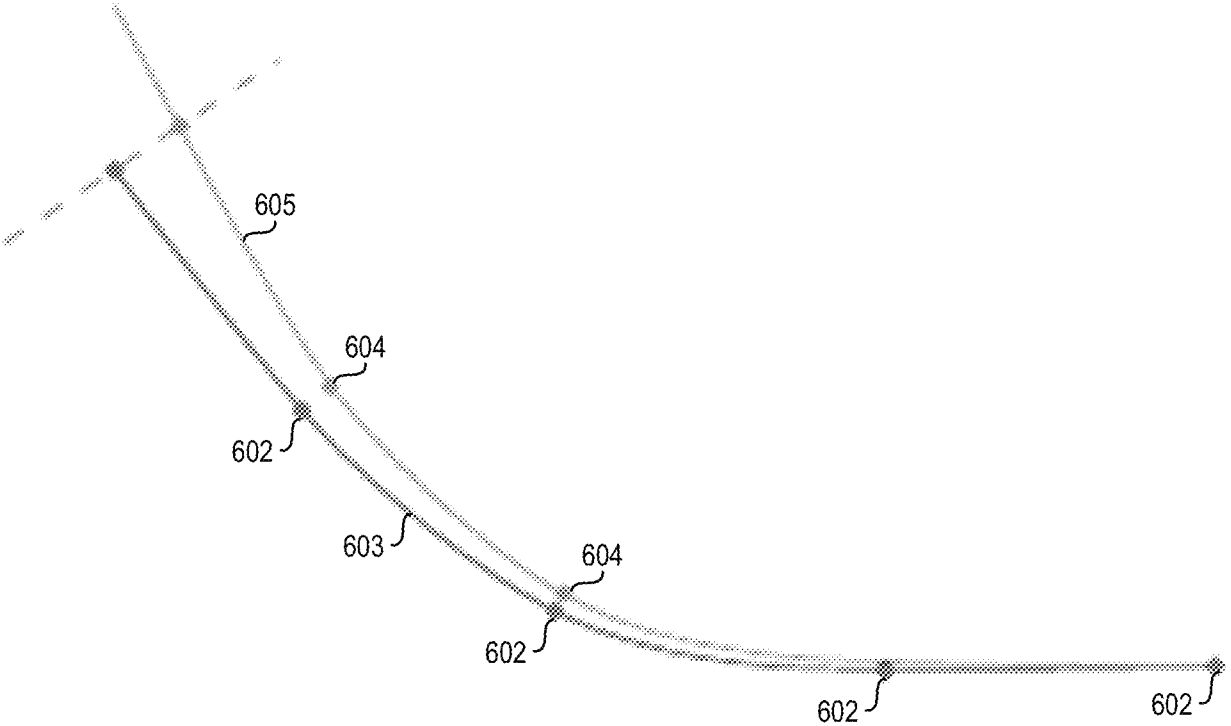
FIG. 6 depicts an example of path optimization according to one or more embodiments described herein.

A desirable solution is defined as adherence to the well plan 321 which may include a smooth, but deliberate, return to plan in the event of a disturbance. For example, FIG. 6 depicts an example of path optimization according to one or more embodiments described herein. The points 602 along the path 603 are the predefined points on the well plan. These can be determined during initialization. The path 605 represents a modelled trajectory (i.e. modelled under certain assumptions, such as certain transmitted steering commands, control modes, or steering parameters) and having corresponding points 604, which are calculated; the points 604 are the points on the predicted trajectory (path 605) closest to the well plan points (e.g., the points 602). A cost function is evaluated with knowledge of the North, East & true vertical depth (TVD) (NED (north, east, down)) coordinates, inclination, and azimuth for some, each, or all of the points 604. The path optimization engine 342 minimizes or maximizing the cost function to ultimately identify the steering commands, control modes, or steering parameters with the least cost. In some examples, suboptimal solutions are acceptable. According to one or more embodiments described herein, the path optimization engine 342 uses a mixed-integer nonlinear program with one or more of constraints to obtain suboptimal solutions. For example, during path optimization for dynamic control scenario detection, various constraints can be considered. Examples of such constraints include maximum dog leg severity (DLS) constraints, minimum DLS constraints for BUR and TR, minimum distance between setpoint/mode changes, minimum absolute changes in setpoint, and the like. These constraints can be configurable and activated at different times depending on customer/system requirements and/or drilling scenario.

With continued reference to FIG. 3, inputs for adaptive trajectory control are now described. The measurement processing engine 330 performs build rate estimation. Particularly, the build rate (and filtered inclination) are determined from a sequence of inclination measurements. In the case of noisy inclination measurements, as an example, a linear Kalman filter can be used and two states modelled, namely the inclination and the build rate. The dynamics may then be modelled as follows:

$$\begin{bmatrix} inc \\ BUR \end{bmatrix}_{k+1} = \begin{bmatrix} 1 & \Delta md \\ 0 & 1 \end{bmatrix} \begin{bmatrix} inc \\ BUR \end{bmatrix}_k$$

The measurement variance is determined directly from the measurements and the process noise is approximated based on the nominal steerability parameter of the tool. Measurement variance and process noise may be used to determine the prediction horizon.

The measurement processing engine 330 may also perform a turn rate estimation. Turn rate estimation determines the turn rate (and filtered azimuth) from a sequence of (noisy) azimuth/inclination measurements. The state equation is a nonlinear function of azimuth and inclination and nonlinear estimators can be used, such as an extended Kalman filter or an unscented Kalman filter. The turn rate is defined as the orthogonal and complementary component to the build rate such that the DLS is achieved. This interpretation is more natural for control purposes. The measurement and process variances are determined analogously to the build rate estimation.

The bit prediction engine 332 predicts the bit position 336 and the bit orientation 338. To do so, the bit prediction engine 332 may operate under one or more assumptions, such as that the measured build/turn rates can be extrapolated from the measurement source to the drill bit 7. Since multiple azimuth measurements are available at different depths, real-time switching between these measurements may be implemented.

According to one or more embodiments described herein, the bit prediction engine 332 predicts the bit inclination (a component of the predicted bit orientation 338) using the following equation:

$$\theta_{bit}=\theta_{SU}+(d_{bit}-d_{SU})\cdot BUR$$

where $d_{bit}$ refers to the depth of the bit and $\theta_{SU}$ and $d_{SU}$ refer to the nearbit inclination and depth of the nearbit inclination, respectively.

Alternatively or in addition, according to one or more embodiments described herein, the bit prediction engine 332 predicts an azimuth of the drill bit 7. Bit azimuth prediction depends on inclination and there are multiple azimuth measurements that can be selected at any time.

Turning now to the control engines 350 of FIG. 3, one or more of the control engines 350 can be activated based on the working plan or optimized trajectory (determined during "path optimization" by the path optimization engine 342) considering the steering capabilities of the BHA. According to one or more embodiments described herein, the adaptive trajectory control framework 310 divides the control problem into two categories: holding a constant angle (inclination or azimuth) and holding a defined build rate or turn rate. For these tasks, separate control engines 350 are designed. In some examples, the control engines 350 control the build and walk direction independently of each other.

In some examples, there may exist different directional drilling scenarios (dependent on predefined control modes) summarized in the following table of directional drilling scenarios that use the following control modes:

| Directional Drilling Scenario | Constant turn rate mode | Azimuth hold mode |
|---|---|---|
| Constant build rate mode | BUR and TR control | BUR and azimuth hold control |
| Inclination hold mode | Inclination hold and TR control | Inclination and azimuth hold control |

The adaptive trajectory control framework 310 supports different rotary steerable BHAs with varying steering capabilities, such as downhole control capabilities. In addition, the adaptive trajectory control framework 310 is able to generate setpoints for surface controllable drilling parameter such as WOB and drillstring RPM. In one or more examples, based on a dynamically acquired list of steering capabilities including steering control capabilities (e.g., downhole inclination hold control, downhole azimuthal hold control, vertical hold control, magnetic steer mode, gravity steer mode available), the control engine of the control engines 350 that makes the best use of the provided downhole control modes is activated. The activation of different control engines 350 is described when using a rotary steerable BHA in directional drilling applications. The rotary steerable BHA contains a steering tool to execute control. The steering set points are provided as the steering proposal 346 by the steering set point generator 344.

For sections of constant inclination within predicted trajectory, consider the following. Many steering tools of rotary steerable systems provide an inclination hold mode. This means, whenever the path optimization engine 342 advises to hold the inclination constant at a certain angle, such angle is set as the target inclination for the downhole inclination hold controller and the build force (which is one of the steering forces) is set high enough to overcome formation pushes. If drift from the target inclination is detected, the build force is increased to compensate for the increased formation push.

The adaptive trajectory control framework 310 provides the possibility to include a surface inclination hold function using the hold control engine 351, which holds inclination constant with steering tools that might not provide a downhole inclination hold capability. In this case, a surface feedback control approach is suggested, which compares the bit inclination estimation to the advised target inclination from the path optimization and reduces or minimizes the control error by downlinking higher or lower build forces respectively in build direction.

For sections of constant azimuth within predicted trajectory, consider the following. If the path optimization performed by the path optimization engine 342 advises to hold azimuth constant at a certain angle, the hold control engine 351 is activated. The hold control engine 351 supports steering tools that provide a downhole azimuth hold mode as well as steering tools which do not provide this capability. For downhole azimuth hold mode steering tools, the hold control engine 351 implements similar functions as for the surface inclination hold function previously described. In one or more examples, a desired azimuth $azi_d$ needs to be corrected by the total azimuth correction (tac), which is used to correct between grid north and magnetic north. In addition, the azimuth measurements from downhole tend to have an additional bias ($bias_{azi}$) when compared to survey measurements. This bias is also calculated in real time and used to compensate the desired azimuth to get the target azimuth set point ($azi_t$) for the downhole controller as follows:

$$azi_t = \mathrm{mod}(azi_d - tac - \mathrm{bias}_{azi}, 2\pi)$$

where mod(number, divisor) returns the remainder after number is divided by divisor. According to one or more embodiments described herein, the adaptive trajectory control framework 310 is constantly analyzing the steering capabilities of the drilling systems. Thus, it can detect automatically whether a downhole azimuthal hold mode is available. When it detects a steering tool which does not provide a downhole azimuth hold capability, a surface azimuth hold feedback function can be activated by the hold control engine 351, which compares the bit azimuth estimation to the advised target azimuth from the path optimization and reduces or minimizes the control error by downlinking higher or lower steering forces respectively to alter the azimuth (i.e. higher or lower walk forces, respectively, that act in walk direction).

In one or more examples, the hold control engine 351 self-adjusts its controller parameters to the current rate of penetration and signal update rate as well as how far the sensor providing the azimuth measurement is placed behind the drill bit. Also, the parameterization is dependent on the steerability (e.g. dogleg severity/dogleg gradient) of the BHA and the current inclination. For large rate of penetrations and/or low signal update rates, the hold control engine parameters are reduced to "relax" the controller to avoid high oscillations and instability of the control loop. The adaptive trajectory control framework 310 can also provide the possibility to automatically revert back from the downhole azimuth hold function to the surface feedback control function in case it detects that the measurement quality of the downhole azimuth used for downhole control is corrupted, while the quality of a different sensor is still sufficient.

For sections of a specified build rate (BUR) within predicted trajectory, consider the following. When the path optimization engine 342 advises sections of constant build rate (positive or negative) or the control scenario detection engine 340 detects such a scenario, the build rate control engine (which can be one of the other control engines 354) is activated. This control engine compares the estimated build rate with the advised build rate from the path optimization block and reduces the error by adjusting the effective build force, for example downhole or via downlink.

The build rate control engine may be implemented as a feedforward-feedback controller. It uses the steerability parameter of the BHA as the feedforward model for build rate. The feedforward part of the build rate control engine provides fast response to changes in the desired build rate values by using a simple model as follows:

$$F_{FF,BUR} = \frac{BUR_d}{\varphi_i}, \text{ where } \varphi_i > 0$$

where $F_{FF,BUR}$ describes the feedforward steering force which is in this case the feedforward build force, $BUR_d$ describes the desired build rate and $\varphi_i$ describes the nominal steerability parameter of the BHA. The effective build force is a combination of the feedforward and feedback terms. The feedback controller, such as a proportional-integral (PI) controller, corrects for model mismatch and enables tracking of the desired value (e.g., monitoring of the measured build rate and/or the build force).

The build rate control engine also self-adjusts its control parameters to the current rate of penetration and signal update rate as well as how far the sensor providing the measurement is placed behind the drill bit. The adaptive trajectory controller is also compatible with a downhole build rate controller.

For sections of a specified turn rate (TR) within predicted trajectory, consider the following. When the path optimization advises sections of constant turn rate (positive or negative) or the scenario detection logic detects such a scenario, the turn rate control engine (which can be one of the other control engines 354) is activated. The turn rate control engine is implemented as a feedforward-feedback controller analogously to the build rate control engine described herein.

For vertical drilling, consider the following. If the steering tool supports a downhole vertical or inclination hold mode, the control engine 350 tailored for advising these setpoints is activated. It may be the same control engine 350 which makes use of the downhole inclination hold mode in sections of constant inclination. For vertical drilling, no control engine for the walk direction is needed, as azimuth is not defined at vertical. Only the inclination needs to be kept constant at 0°.

For magnetic kick-off, consider the following. The magnetic kick off is basically a section of constant azimuth and a certain build rate. The build rate is controlled using the build rate control engine previously described. To kick off the well with the correct azimuth, the magnetic steer mode of the steering tool may be used. For the magnetic steer mode, the proposed magnetic steer direction $\phi_{mag}$ may be calculated as follows:

$$\phi_{mag} = azi_d - tac$$

where $azi_d$ describes the desired azimuth in which the well is to be kicked off and tac is the total azimuth correction.

For reservoir navigation, consider the following. When conducting reservoir navigation, a suitable control engine 350 is activated to allow the drilling system to follow small changes in inclination and TVD (true vertical depth) precisely. The control engine 350 can be similar (e.g., feedback control), only the controller parametrization changes.

With continued reference to FIG. 3, once the appropriate control engine(s) 350 are selected, the steering proposal 346 is generated by the steering set point generator 344. The effective steering forces, such as the effective build and walk forces, as well as the target inclination and target azimuth, provided by the control engines 350 are combined into a meaningful steering proposal 346, which may include steering set points. For this objective, the steering set point generator 344 analyzes which control engine 350 is currently active (e.g. for build and walk direction) and if other control engines 350 (e.g. downhole inclination or azimuth hold control) are available and could be used. The steering set point generator 344 translates the control outputs from the control engines 350 into steering commands (e.g. communicable steering commands, such as downlinkable steering commands) when using setpoint changes of the BHA are desired or set points for the drilling rig when changes of the surface controllable drilling parameters are desired.

The following table represents the translation of the control engine 350 proposals into a steering downlink set point in the case where no downhole azimuth hold mode is available or used:

| | Constant azimuth | Turn left/right |
|---|---|---|
| Constant inclination | Use downhole inclination hold mode<br>Set target inclination as specified by the path optimization<br>Set build force limit for the downhole controller as specified by inclination hold control engine<br>Set walk force as specified by the azimuth hold control engine | Use downhole inclination hold mode<br>Set target inclination as specified by the path optimization<br>Set build force limit for the downhole controller as specified by inclination hold control engine<br>Set walk force as derived from the turn rate control engine |
| Build/Drop | Use Gravity steer mode:<br>Set steering force and steer direction as the combination of setpoints from the build rate and azimuth hold control engines | Use Gravity steer mode:<br>Set steering force and steer direction as the combination of setpoints from the build rate and turn rate control engines |

The following table represents the translation of the control engine 350 proposals into a steering downlink set point in case downhole azimuth hold mode is used:

| | Constant azimuth | Turn left/right |
|---|---|---|
| Constant inclination | Use downhole 3D hold mode<br>Set target inclination and azimuth as specified by the path optimization<br>Set build force limit for the downhole controller as specified by the inclination hold control engine<br>Set walk force limit for the downhole controller as specified by the azimuth hold control engine | Use downhole inclination hold mode<br>Set target inclination as specified by the path optimization<br>Set build force limit for the downhole controller as specified by inclination hold control engine<br>Set walk force as derived from the turn rate control engine |
| Build/Drop | Azimuth hold mode:<br>Set target azimuth as specified by the path optimization<br>Set walk force limit for the downhole | Use Gravity steer mode:<br>Set steering force and steer direction as the combination of setpoints from the build rate and |

-continued

| Constant azimuth | Turn left/right |
|---|---|
| controller as specified by the azimuth hold control engine Set build force as derived from the build rate control engine | turn rate control engines |

For vertical sections the vertical mode can be used if it is available. The build force is then set to the value provided by the activated hold control engine 351, making use of the downhole control mode. If no vertical mode is available, but the downhole inclination hold mode, this mode can be used, and the target inclination is set to 0°. The build force may be similar to the one used for vertical mode. For the magnetic kick off the magnetic steer mode may be used. The steering force is specified by the build rate control engine and the magnetic steer direction is set as described herein regarding activation of control engines.

According to one or more embodiments described herein, to avoid sending of steering commands (e.g. sending by time consuming and therefore costly downlinks) whenever a small change of the parameters is proposed by one or more of the control engines 350, a logic can be implemented in the steering set point generator 344 such that steering commands are sent only if the desired change of at least one parameter is significant (e.g., the desired parameter change is above a threshold).

The adaptive trajectory control framework 310 can be implemented in various environments and/or to achieve different desired results. The adaptive trajectory control framework 310 can automatically generate steering setpoints for the BHA 13 to follow the well plan 321 while the directional driller observes the progress. The steering setpoints can be converted into downlink commands and sent automatically to the steering tool. If automated control of the wellbore is not desired, the adaptive trajectory control framework 310 can still assist the directional driller with steering setpoint proposals whenever a course correction is desired, but in such cases the directional driller would apply the setpoint changes.

The adaptive trajectory control framework 310 can also be used to generate setpoints for the surface controllable drilling parameters such as ROP, WOB, and drill string RPM (and/or combinations thereof) to supplement directional drilling with an RSS or bent motor BHA. These setpoints are submitted to the rig control system.

The adaptive trajectory control framework 310 can also be used for directional drilling with bent motor BHAs. In this case, a control engine 350 that calculates steering setpoints for rotating (and rotating length) or sliding (and sliding length) and toolface is implemented in the adaptive trajectory control framework 310. These setpoints are then submitted to the wellbore operation system 100. The adaptive trajectory control framework 310 can automatically detect the lack of a downhole steering command and activate a rotating/sliding control engine automatically without requiring additional configuration effort.

The adaptive trajectory control framework 310 can be used to drill a deviated wellbore using a quasi-static well plan (which is not updated or only rarely updated, such as less than 10 times updated, while the BHA is in the wellbore), or using a well plan that is dynamically updated, for example for reservoir navigation applications to maximize reservoir contact based on while drilling data 322 received while drilling. To drill deviated wellbores using a quasi-static well plan, a low-bandwidth control engine and a long prediction horizon are used to avoid unwanted tortuosity and non-productive time through excessive downlinking. In the second application where the well plan is dynamically updated, a control engine with a higher bandwidth (such as a higher bandwidth than the bandwidth that is used when using a quasi-static well plan) and/or a shorter prediction horizon (such as a prediction horizon than the prediction horizon that is used when using a quasi-static well plan) is used to react quickly to well plan updates, e.g. to maximize reservoir contact. Using the adaptive trajectory control framework 310, both implementations are available and can be selected automatically through the control scenario detection performed by the control scenario detection engine 340.

The adaptive trajectory control framework 310 is suitable in a variety of directional drilling scenarios, including, for example: drilling a vertical section; kicking off a deviated wellbore; drilling the curve, including build, drop, turn, and any combination of those; drilling the lateral, including tangents with inclination different to ~90 degrees and/or tangent inclination with inclination equal to ~90 degrees; and the like.

According to one or more embodiments described herein, the adaptive trajectory control framework 310 detects the drilling scenarios automatically using the control scenario detection engine 340, analyses the available steering commands of the BHA 13 automatically using the path optimization engine 342, and activates one or more of the control engines 350 as appropriate to generate the steering proposal 346.

Another application is to make use of the path optimization embedded in the adaptive trajectory control framework 310 to provide the directional driller with real-time working plan updates while satisfying the drilling constraints, such as maximum allowed curvature and maximum allowed distance to plan. By providing working plan updates the adaptive trajectory control framework 310 acts as a real-time navigation system indicating to the directional driller the future trajectory to the drilling target. Furthermore, the adaptive trajectory control framework 310 provides for changing the drilling constraints in real-time. Thus, the directional driller can conduct scenario planning using the adaptive trajectory control framework 310. For example, a path optimization advisory mode can be implemented to provide for the directional driller to study the effects of changing optimization constraints. Tedious manual calculations are no longer necessary.

According to one or more embodiments described herein, the adaptive trajectory control framework 310 can trigger an alarm when no suitable working plans can be found. The alarm is triggered proactively as early as the situation is detected. In this situation, control is given back to the directional driller who can be visually and/or acoustically informed. Furthermore, the adaptive trajectory control framework 310 can continuously analyze its inputs (e.g., the data 320) in real-time (or near real-time) and inform the driller when one of the inputs is missing, is not provided with the required data rate, has too many outliers, etc.

The adaptive trajectory control framework 310 also provides automated control scenario detection to the directional driller. This allows the directional driller to supervise several wellbores at the same time. For example, the directional driller may decide to drill wellbore A in automatic mode until the lateral section is reached while conducting geosteering on wellbore B manually. The adaptive trajectory control framework 310 informs the directional driller automatically when the control scenario changes in each wellbore.

Figure 7:
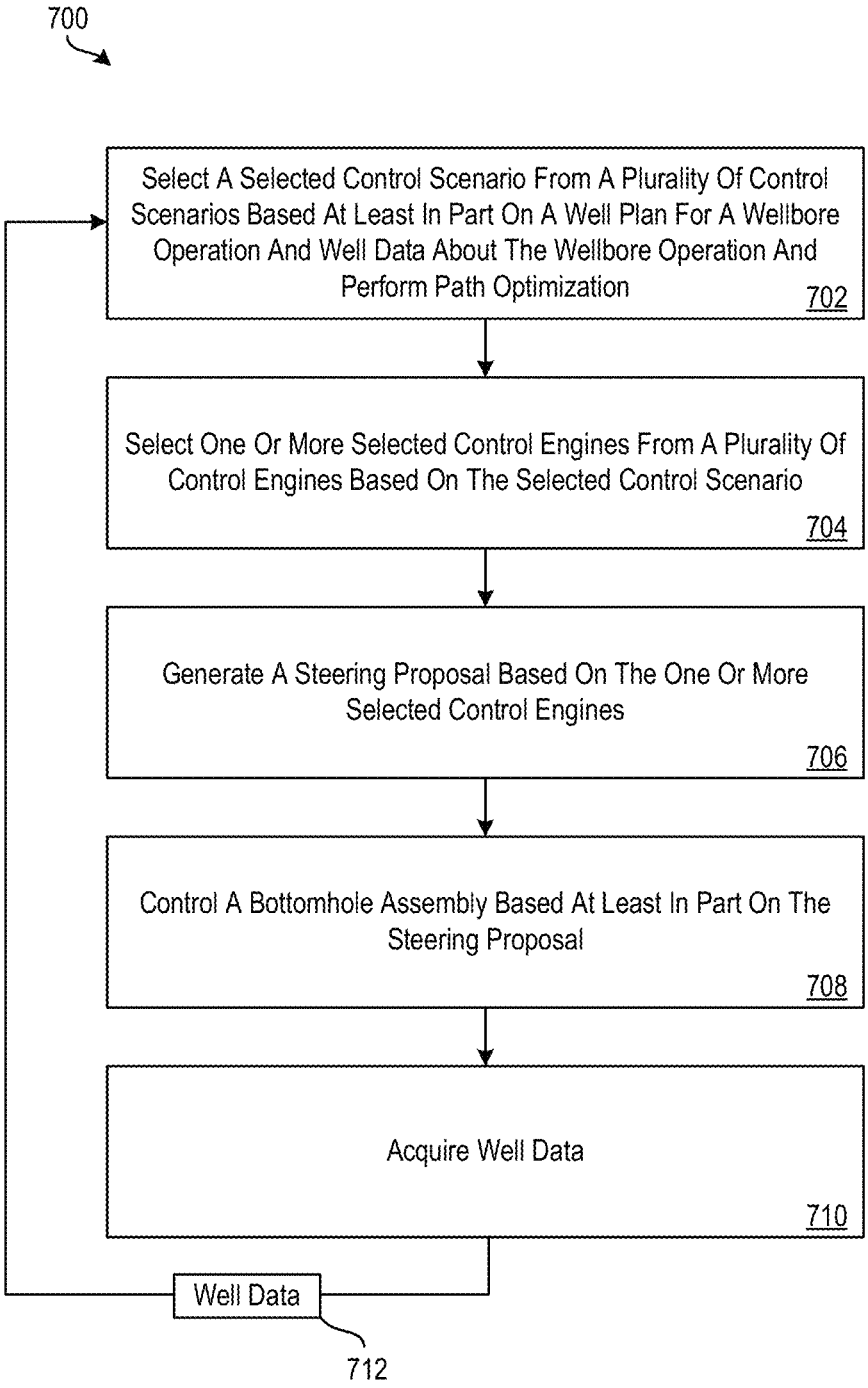
FIG. 7 depicts a flow diagram of a method for controlling a bottom hole assembly according to one or more embodiments described herein.

FIG. 7 depicts a flow diagram of a method 700 for controlling a bottom hole assembly according to one or more embodiments described herein. The method 700 can be performed by any suitable processing system (e.g., the processing system 12, the downhole electronic components 9), any suitable processing device (e.g., one of the processors 21), and/or combinations thereof or the like or another suitable system or device.

At block 702, a processing system (e.g., the processing system 12, the downhole electronic components 9, etc.), using the control scenario detection engine 340, selects a selected control scenario from a plurality of control scenarios. The selection can be based at least in part on a well plan (e.g., the well plan and constraints 321) for a wellbore operation and well data about the wellbore operation (e.g., the while drilling data 322, the survey data 323, the actual steering parameters 324, and/or the steering capabilities, such as steering commands 325 for steering the BHA 13 including the steering tool, available set points or set point ranges in accordance with the well plan and constraints 321, and/or predicted/modelled wellbore trajectories). Using the static control scenario detection described herein, the control scenario can be determined by considering the well plan. In this case, the estimated or predicted bit position 336 is used to find the nearest point on the well plan 321. The next planned section change in build and walk direction is identified in the remainder of the well plan 321. Using the dynamic control scenario detection described herein, the estimated or predicted bit position 336 and estimated or predicted bit orientation 338 are used as a starting point for path optimization (although the survey position and survey orientation could be used as the starting point in other examples). The path optimization engine 342 performs path optimization and determines whether to introduce a section of constant build rate, turn rate, inclination, and/or azimuth.

At block 704, the processing system selects one or more selected control engines from a plurality of control engines (e.g., the control engines 350) based on the selected control scenario (which can be selected based on the static control scenario detection and/or the dynamic control scenario detection). For example, the path optimization engine 342 determines an optimized "working plan" based on the current bit state (e.g., the predicted bit position 336 and the predicted bit orientation 338), survey data 323, and the well plan and constraints 321. The working plan describes the desired setpoint changes to steer the BHA back to the well plan (e.g., the well plan of the well plan and constraints 321) within a given prediction horizon. Control engines are selected to implement the working plan. For example, the hold control engine 350 may be selected to implement an inclination hold action. The control engine selection and/or working plan determination may be done by optimizing (e g minimizing or maximizing) one or more associated cost functions.

At block 706, the processing system, using the steering set point generator 344, generates a steering proposal based on the one or more selected control engines. For example, effective build and walk forces, as well as the target inclination and target azimuth, provided by the control engines 350 are combined into a meaningful steering proposal 346, which may include steering set points. The steering command selection and/or the set point determination may be done by optimizing (minimizing or maximizing) one or more associated cost functions.

At block 708, the processing system controls the BHA 13 based at least in part on the steering proposal. That is, the set points are used to control (e.g., steer) the BHA 13 back to the well plan (e.g., the well plan 321). At block 710, one or more measurement systems acquire well data 712 (e.g., directional data—such as inclination, azimuth, toolface— WOB, ROP, RPM, depth, etc.) that is fed back to block 702 to be used in the next control cycle.

Additional processes also may be included, and it should be understood that the processes depicted in FIG. 7 represent illustrations, and that other processes may be added or existing processes may be removed, modified, or rearranged without departing from the scope of the present disclosure.

One or more of the embodiments described herein can provide one or more of the following advantages. The automated adaptive trajectory control system provides steering commands to the BHA to adhere to the well plan while satisfying given constraints (e.g., a maximum dogleg severity), thereby providing for automated directional drilling of the wellbore. The well plan may be defined prior to or during drilling. The adaptive trajectory control framework can be used for different types of drilling operations, such as RSS and bent motor BHAs among others. The adaptive trajectory control system can operate without a physics-based drill-ahead model. The adaptive trajectory control system is scalable such that dedicated control engines can be implemented for specific control scenarios. The adaptive trajectory control system receives the supported steering commands from the RSS BHA automatically and in real-time (or near real-time). The adaptive trajectory control system analyzes the available steering commands in the BHA and selects from control modes which are available. The adaptive trajectory control system derives steering commands, which satisfy the constraints, such as maximum dogleg severity or maximum distance from the well plan. The adaptive trajectory control system can receive well plan updates automatically. The adaptive trajectory control system provides working plan updates to a directional driller; the directional driller is not required to perform manual calculations. The adaptive trajectory control system is agnostic to the downhole communication channel used between a processing system at the surface and the BHA; for example, it can be used with any downhole telemetry protocol such as mud pulse telemetry. The adaptive trajectory control framework can be extended to other drilling applications, such as ROP optimization and hole cleaning optimization, trip speed optimization.

Example embodiments of the disclosure include or yield various technical features, technical effects, and/or improvements to technology. Example embodiments of the disclosure provide technical solutions for automated directional drilling. These technical solutions provide an adaptive control framework that detects a control scenario in real-time (or near-real-time), automatically selects one or more control engines suitable for the scenario, and generates a steering proposal using the selected one or more control engines to cause a BHA to follow a predetermined trajectory. The adaptive control framework provides a real-time (or near-real-time) trajectory optimization scheme that generates optimal build and turn rate and azimuth and inclination hold setpoints to adhere to the well plan. This enables a BHA to be controlled automatically and more efficiently than conventional approaches to steering BHAs. This increases hydrocarbon recovery from a hydrocarbon reservoir compared to conventional techniques.

Set forth below are some embodiments of the foregoing disclosure:

Embodiment 1: A method for drilling a wellbore by a wellbore operation system into a subsurface of the earth, the wellbore operation system comprising a bottom hole assembly, the method comprising: conveying the bottom hole assembly into the wellbore; selecting a well plan for the wellbore; measuring well data by at least one sensor in the wellbore operation system while the bottom hole assembly is in the wellbore; generating, by a processing device, a steering proposal based at least in part on the well plan and the well data; and drilling, with the wellbore operation system, at least a portion of the wellbore based at least in part on the steering proposal.

Embodiment 2: A method according to any prior embodiment, further comprising: selecting a control scenario from a plurality of control scenarios based at least in part on the well plan and the well data; selecting, by the processing device, one or more selected control engines from a plurality of control engines based at least in part on the selected control scenario; and generating the steering proposal by using at least one of the one or more selected control engines.

Embodiment 3: A method according to any prior embodiment, further comprising analyzing, by the processing device, the well plan and the well data to determine a build rate estimate, a turn rate estimate, a predicted bit position, and a predicted bit orientation, and wherein selecting the selected control scenario from the plurality of control scenarios is further based at least in part on one or more of the build rate estimate, the turn rate estimate, the predicted bit position, the predicted bit orientation, or the well data.

Embodiment 4: A method according to any prior embodiment, wherein a first portion of the processing device is disposed at a surface location and a second portion of the processing device is disposed in the bottom hole assembly.

Embodiment 5: A method according to any prior embodiment, wherein the one or more selected control engines are selected from a group consisting of a hold control engine and a curve control engine.

Embodiment 6: A method according to any prior embodiment, wherein the bottom hole assembly is a bent motor bottom hole assembly.

Embodiment 7: A method according to any prior embodiment, wherein selecting the selected control scenario is performed statically based at least in part on the well plan or performed dynamically based at least in part on a trajectory optimization.

Embodiment 8: A method according to any prior embodiment, further comprising: estimating, by the processing device, steering capabilities of the wellbore operation system based at least in part on the well data and/or the bottom hole assembly, wherein the steering proposal is generated by the processing device by using the steering capabilities.

Embodiment 9: A method according to any prior embodiment, wherein the wellbore operation system is configured to cause a steering action in response to sending one or more available steering commands to the bottom hole assembly, and wherein estimation of the steering capabilities is based at least in part on modeling a trajectory of the wellbore in response to sending the one or more available steering commands to the bottom hole assembly.

Embodiment 10: A method according to any prior embodiment, wherein the steering proposal is generated by optimizing a cost function associated with the modeled trajectory of the wellbore.

Embodiment 11: A method according to any prior embodiment, wherein the steering proposal is generated at a first time and the method further comprises transmitting the steering proposal to the bottom hole assembly at a second time later than the first time.

Embodiment 12: A system comprising a wellbore operation system comprising a bottom hole assembly disposed in a wellbore; a sensor in the wellbore operation system configured to generate well data related to a wellbore operation while the bottom hole assembly is in the wellbore; a processing system comprising a memory and a processor, the processing system executing computer readable instructions to perform operations to: generate a steering proposal based at least in part on a well plan for the wellbore operation and the well data; and control the bottom hole assembly based at least in part on the steering proposal.

Embodiment 13: A system according to any prior embodiment, wherein the operations further comprise: selecting a control scenario from a plurality of control scenarios based at least in part on the well plan and the well data; selecting one or more selected control engines from a plurality of control engines based at least in part on the selected control scenario; and generating the steering proposal by using at least one of the one or more selected control engines.

Embodiment 14: A system according to any prior embodiment, wherein the operations further comprise: analyzing the well plan and the well data to determine a build rate estimate, a turn rate estimate, a predicted bit position, and a predicted bit orientation, and wherein selecting the selected control scenario from the plurality of control scenarios is further based at least in part on one or more of the build rate estimate, the turn rate estimate, the predicted bit position, the predicted bit orientation, or the well data.

Embodiment 15: A system according to any prior embodiment, wherein a first portion of the processing system is disposed at a surface location and a second portion of the processing system is disposed in the bottom hole assembly.

Embodiment 16: A system according to any prior embodiment, wherein the one or more selected control engines are selected from a group consisting of a hold control engine and a curve control engine.

Embodiment 17: A system according to any prior embodiment, wherein the bottom hole assembly is a bent motor bottom hole assembly.

Embodiment 18: A system according to any prior embodiment, wherein the operations further comprise estimating steering capabilities of the wellbore operation system based at least in part on at least one of the well data or the bottom hole assembly, and wherein the steering proposal is generated by the processing system by using the steering capabilities.

Embodiment 19: A system according to any prior embodiment, wherein the wellbore operation system is configured to cause a steering action in response to sending one or more available steering commands to the bottom hole assembly, and wherein estimating the steering capabilities is based at least in part on modeling a trajectory of the wellbore in response to sending the one or more available steering commands to the bottom hole assembly.

Embodiment 20: A system according to any prior embodiment, wherein the steering proposal is generated by optimizing a cost function associated with the modeled trajectory of the wellbore.

The use of the terms "a" and "an" and "the" and similar referents in the context of describing the present disclosure (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure can be used in a variety of well operations. These operations can involve using one or more treatment agents to treat a formation, the fluids resident in a formation, a wellbore, and/or equipment in the wellbore, such as production tubing. The treatment agents can be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the present disclosure has been described with reference to an exemplary embodiment or embodiments, it will be understood by those skilled in the art that various changes can be made and equivalents can be substituted for elements thereof without departing from the scope of the present disclosure. In addition, many modifications can be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims. Also, in the drawings and the description, there have been disclosed exemplary embodiments of the present disclosure and, although specific terms can have been employed, they are unless otherwise stated used in a generic and descriptive sense only and not for purposes of limitation, the scope of the present disclosure therefore not being so limited.

What is claimed is:

1. A method for drilling a wellbore by a wellbore operation system into a subsurface of the earth, the wellbore operation system comprising a bottom hole assembly, the method comprising:

conveying the bottom hole assembly into the wellbore;

selecting a well plan for the wellbore;

measuring well data by at least one sensor in the wellbore operation system while the bottom hole assembly is in the wellbore;

receiving, at a processing device, a list of available steering commands from the bottom hole assembly;

generating, by a processing device, a steering proposal based at least in part on the well plan and the well data;

selecting a steering command from the list of available steering commands based on the steering proposal and a steering capability of the bottom hole assembly; and drilling, with the wellbore operation system, at least a portion of the wellbore based at least in part on the selected steering command.

2. The method of claim 1, further comprising:

selecting a control scenario from a plurality of control scenarios based at least in part on the well plan and the well data;

selecting, by the processing device, one or more control engines from a plurality of control engines based at least in part on the selected control scenario; and generating the steering proposal by using at least one of the one or more control engines.

3. The method of claim 2, further comprising:

analyzing, by the processing device, the well plan and the well data to determine a build rate estimate, a turn rate estimate, a predicted bit position, and a predicted bit orientation, and wherein selecting the control scenario from the plurality of control scenarios is further based at least in part on a condition of the control scenario and one or more of the build rate estimate, the turn rate estimate, the predicted bit position, the predicted bit orientation, or the well data.

4. The method of claim 2, wherein the one or more control engines are selected from a group consisting of a hold control engine and a curve control engine.

5. The method of claim 2, wherein selecting the control scenario is performed statically based at least in part on the well plan or performed dynamically based at least in part on a trajectory optimization.

6. The method of claim 1, wherein a first portion of the processing device is disposed at a surface location and a second portion of the processing device is disposed in the bottom hole assembly.

7. The method of claim 1, wherein the bottom hole assembly is a bent motor bottom hole assembly.

8. The method of claim 1, wherein the wellbore operation system is configured to cause a steering action in response to sending one or more available steering commands to the bottom hole assembly, further comprising determining a steering capability based at least in part on modeling a trajectory of the wellbore in response to sending the one or more available steering commands to the bottom hole assembly.

9. The method of claim 8, wherein the steering proposal is generated by optimizing a cost function associated with the modeled trajectory of the wellbore.

10. The method of claim 1, wherein the steering proposal is generated at a first time and the method further comprises transmitting the steering proposal to the bottom hole assembly at a second time later than the first time.

11. A system comprising:

a wellbore operation system comprising a bottom hole assembly disposed in a wellbore;

a sensor in the wellbore operation system configured to generate well data related to a wellbore operation while the bottom hole assembly is in the wellbore;

a processing system comprising a memory and a processor, the processing system executing computer readable instructions to perform operations to:

receiving a list of available steering commands from the bottom hole assembly;

generating a steering proposal based at least in part on a well plan for the wellbore operation and the well data;

selecting a steering command from the list of available steering commands based on the steering proposal and a steering capability of the bottom hole assembly; and controlling the bottom hole assembly to drill at least a portion of the wellbore based at least in part on the steering command.

12. The system of claim 11, wherein the operations further comprise:

selecting a control scenario from a plurality of control scenarios based at least in part on the well plan and the well data;

selecting one or more control engines from a plurality of control engines based at least in part on the control scenario; and generating the steering proposal by using at least one of the one or more control engines.

13. The system of claim 12, wherein the operations further comprise: analyzing the well plan and the well data to determine a build rate estimate, a turn rate estimate, a predicted bit position, and a predicted bit orientation, and wherein selecting the control scenario from the plurality of control scenarios is further based at least in part on one or more of the build rate estimate, the turn rate estimate, the predicted bit position, the predicted bit orientation, or the well data.

14. The system of claim 12, wherein the one or more selected engines are selected from a group consisting of a hold control engine and a curve control engine.

15. The system of claim 11, wherein a first portion of the processing system is disposed at a surface location and a second portion of the processing system is disposed in the bottom hole assembly.

16. The system of claim 11, wherein the bottom hole assembly is a bent motor bottom hole assembly.

17. The system of claim 11, wherein the wellbore operation system is configured to cause a steering action in response to sending one or more available steering commands to the bottom hole assembly, and a steering capability of the bottomhole assembly is determined is based at least in part on modeling a trajectory of the wellbore in response to sending the one or more available steering commands to the bottom hole assembly.

18. The system of claim 17, wherein the steering proposal is generated by optimizing a cost function associated with the modeled trajectory of the wellbore.

* * * * *